US006592806B2

(12) United States Patent
Kamikawa et al.

(10) Patent No.: US 6,592,806 B2
(45) Date of Patent: Jul. 15, 2003

(54) REDUCED IRON DISCHARGER IN ROTARY HEARTH REDUCING FURNACE

(75) Inventors: Susumu Kamikawa, Hiroshima (JP); Hironori Fujioka, Hiroshima (JP); Hiromi Osaka, Hiroshima (JP); Keiichi Sato, Hiroshima (JP); Yoshimitsu Onaka, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 9 days.

(21) Appl. No.: 09/828,805

(22) Filed: Apr. 10, 2001

(65) Prior Publication Data

US 2002/0003325 A1 Jan. 10, 2002

(30) Foreign Application Priority Data

Jul. 5, 2000 (JP) ..... 2000-203530

(51) Int. Cl.[7] ..... C21B 13/08
(52) U.S. Cl. ..... 266/195

(58) Field of Search ..... 266/195, 177, 266/175

(56) References Cited

U.S. PATENT DOCUMENTS 3,370,937 A * 2/1968 Tsujihata et al. ..... 266/195
3,763,011 A * 10/1973 Allred ..... 432/138
3,988,012 A * 10/1976 Jemal ..... 266/179

* cited by examiner

*Primary Examiner*—Melvyn Andrews
(74) *Attorney, Agent, or Firm*—Birch, Stewart, Kolasch & Birch, LLP

(57) ABSTRACT

A reduced iron discharger in a rotary hearth reducing furnace scoops up reduced iron on a rotary hearth from a front side with the use of an impeller enough long to cover the entire width of the rotary hearth, drops the reduced iron onto a vibrating conveyor mounted in the impeller, and discharges it from an outlet to the outside of the reducing furnace. The reduced iron discharger involves minimal structural waste, and gives a satisfactory yield.

5 Claims, 9 Drawing Sheets

Relationship Among Minimum Screw Rotational Speed, Hearth Rotational Speed, and Volume of Production

REDUCED IRON DISCHARGER IN ROTARY HEARTH REDUCING FURNACE

The entire disclosure of Japanese Patent Application No. 2000-203530 filed on Jul. 5, 2000 including specification, claims, drawings and summary is incorporated herein by reference in its entirety.

BACKGROUND OF THE INVENTION

1. Field of the Invention

The present invention relates to a reduced iron discharger in a rotary hearth reducing furnace for producing reduced iron by reducing, in a high temperature atmosphere, pellet-or briquette-like agglomerates which have been formed from a powdery mixture of an iron oxide powder and a reducing agent and supplied onto a rotary hearth.

2. Description of the Related Art

To produce reduced iron, the first step is, generally, to mix a powder of iron ore (iron oxide), a powder of coal (reducing agent), a powder of limestone (fluxing agent), and a binder such as bentonite, and to compress and pelletize the mixture to form wet balls called "green balls." Then, the wet balls are dried to some degree to form dry balls. The dry balls are heated to a high temperature in a reducing furnace, where the iron oxide in the iron ore is reduced by the coal as a reducing agent to form reduced iron in the form of pellets.

An example of an apparatus for producing such reduced iron is explained by way of FIG. 7. Powders of iron ore, coal, etc. and a binder are mixed in a mixer (not shown). The resulting mixed powder is pelletized in a pelletizer 1 to form green balls (green or raw pellets) GB. Then, the green balls GB are charged into a dryer 2, where they are dried with an off-gas from a reducing furnace 4 (to be described later on) to form dry balls DB. The dry balls DB are supplied to the reducing furnace 4 by a pellet feeder 3.

The interior of the reducing furnace 4 is maintained in a high temperature atmosphere upon heating by a burner 5, and an inside off-gas is discharged from an off-gas duct 6. Thus, the dry balls DB are preheated and heated with radiant heat from the wall of the furnace when they are passed through the interior of the reducing furnace 4. During their passage, the iron oxide in the iron ore is reduced with the coal as the reducing agent to form reduced iron in the form of pellets. The reduced pellets are discharged to the outside by a pellet discharger 8, and accommodated into a portable vessel 9.

The off-gas from the off-gas duct 6 usually contains some unburned gas, and is thus burned in an after burner chamber 7 nearly completely. Then, the off-gas is cooled in a water spray primary cooler 10, and then sent to a heat exchanger 11, where it undergoes heat exchange. Combustion air heated by the heat exchange is sent to the reducing furnace 4, and fed into the furnace together with fuel. On the other hand, the off-gas is cooled again in a secondary cooler 12, and part of it is sent to the dryer 2 as drying air for the green balls GB as stated earlier. The remaining part of the off-gas is cleaned in a dust collector 13, and released into the atmosphere via a stack 14.

A screw discharger as shown in FIG. 8 has been used as the pellet discharger 8. When this discharger is used, a rotary hearth 15 is supported by a floor rail 16 disposed concentrically in a furnace chamber, and a horizontal roller 18 disposed in an inner peripheral portion of a furnace wall 17 in such a manner that a wheel 19 contacts the floor rail 16 and a side surface rail 20 of the rotary hearth 15 itself contacts the horizontal roller 18. The rotary hearth 15 is rotated by a rotational drive system (not shown), with a space between the rotary hearth 15 and the furnace wall 17 being sealed with a water groove 21. A discharge screw 62 having a spiral blade 62*a* is mounted across the rotary hearth 15, with a tiny gap being kept between the discharge screw 62 and the upper surface of the rotary hearth 15, and a shaft end portion of the discharge screw 62 is supported by a bearing 63. The discharge screw 62 is rotated by a motor 64 in the direction indicated by an arrow 65 in the drawing. As a result, reduced iron P on the rotary hearth 15 is raked out by the spiral blade 62*a* toward a discharge port on the right side in the drawing.

With the conventional screw discharger, the reduced iron raked out from a site on the moving rotary hearth 15 in a perpendicularly lateral direction by the spiral blade 62*a* increases in amount and becomes bulky as it approaches the discharge port in the end portion of the discharge screw 62, as shown by the symbol P in FIG. 8. Thus, the height of the spiral blade 62*a* needs to be consistent with the amount of reduced iron at the discharge port. Hence, the entrance side of the discharge screw 62 (i.e., the side opposite to the discharge port), where the amount of reduced iron is small, faces the problem that the height of the blade made of an expensive heat resistant steel is useless. Besides, during raking-out by the discharge screw 62, the reduced iron at a high temperature is converted into a powder or powdered under the pressure of the spiral blade 62*a* , resulting in a decreased yield.

The rotational speed of the discharge screw 62 is linked to the volume of production by the reducing furnace. That is, if the discharge screw 62 rotates in the same manner when the amount of green pellets supplied into the furnace increases, not all of the reduced iron P will be discharged, and some of the reduced iron P escapes the discharge screw 62. To increase the volume of production, therefore, the rotational speed of the discharge screw 62 must be increased.

FIG. 9 is a graph showing the relationship between the necessary rotational speed of the discharge screw 62, the rotational speed of the rotary hearth 15, and the volume of production. The horizontal axis represents the volume of production (t/hr), and the vertical axis represents the screw speed (r.p.m.). As an example, the graph shows the course of the necessary rotational speed of the discharge screw 62 in response to changes in volume of production in the reducing furnace whose hearth rotational speed is 6 rotations per hour. When the hearth rotational speed is 6 rotations per hour, the corresponding screw speed is 7 rotations per minute. At this screw rotational speed, the volume producible without escape of reduced iron is up to about 45 tons per hour. To produce a greater volume, the screw rotational speed should be increased in proportion to the increase in the volume of production. When the rotational speed of the discharge screw 62 increases, the speed of the reduced iron P discharged from the reducing furnace becomes high. As a result, powdering of the high temperature reduced iron due to collision is accelerated, aggravating the aforementioned decrease in the yield.

SUMMARY OF THE INVENTION

The present invention has been proposed in light of these circumstances. It is an object of this invention to provide a reduced iron discharger in a rotary hearth reducing furnace, which involves minimal structural waste and obtains a satisfactory yield.

A first aspect of the present invention, as a means of attaining the above object, is a reduced iron discharger in a rotary hearth reducing furnace for producing reduced iron by reducing agglomerates in a high temperature atmosphere, the agglomerates being pelletized from a powdery mixture of an iron oxide powder and a reducing agent and supplied onto a rotary hearth, wherein rotary blades capable of discharging the reduced iron from a site on the rotary hearth are provided. Thus, the reduced iron discharger can serve as an apparatus which involves minimal structural waste and obtains a satisfactory yield.

A second aspect of the invention is the above-mentioned reduced iron discharger in a rotary hearth reducing furnace, wherein the blades each comprise a body member and a front end member detachably provided on the body member. Thus, when the front end portion of the blade wears, only the front end member can be replaced easily.

A third aspect of the invention is the above reduced iron discharger in a rotary hearth reducing furnace, wherein the body member is reinforced with a rib. Thus, the durability of the blade is increased.

A fourth aspect of the invention is the above reduced iron discharger in a rotary hearth reducing furnace, wherein the blades are composed of an impeller which rotates about an axis extending across the rotary hearth and scoops up the reduced iron, and a transport device for accepting the reduced iron falling at a rotating ascending position of the impeller, and discharging the reduced iron to the outside of the furnace is mounted in the impeller. Thus, the same effect as in the first aspect of the invention can be obtained.

A fifth aspect of the invention is the above reduced iron discharger in a rotary hearth reducing furnace, wherein the transport device is a vibrating conveyor disposed obliquely across the rotary hearth. Thus, reduced iron can be discharged smoothly.

A sixth aspect of the invention is the above reduced iron discharger in a rotary hearth reducing furnace, wherein the blades are composed of raking-out devices which rotate across the rotary hearth to rake out the reduced iron. Thus, the same effect as in the first aspect of the invention is obtained, and the transport device in the fourth aspect of the invention becomes unnecessary.

A seventh aspect of the invention is the above reduced iron discharger in a rotary hearth reducing furnace, wherein the width of each of the blades is set in accordance with the maximum speed of the rotary hearth. Thus, the amount of reduced iron escaping the raking-out devices can be decreased, without the need to increase the rotational speed of the raking-out devices in response to an increase in the volume of production in an operation for production of up to a high volume.

An eighth aspect of the invention is the above reduced iron discharger in a rotary hearth reducing furnace, wherein cooling means is provided for cooling the blades, which have discharged the reduced iron, above the hearth. Thus, the heat load of the blades is reduced to improve the durability of the blades.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Embodiments of the present invention will now be described in detail with reference to the accompanying drawings, which in no way limit the invention.

[First Embodiment]

Figure 1:
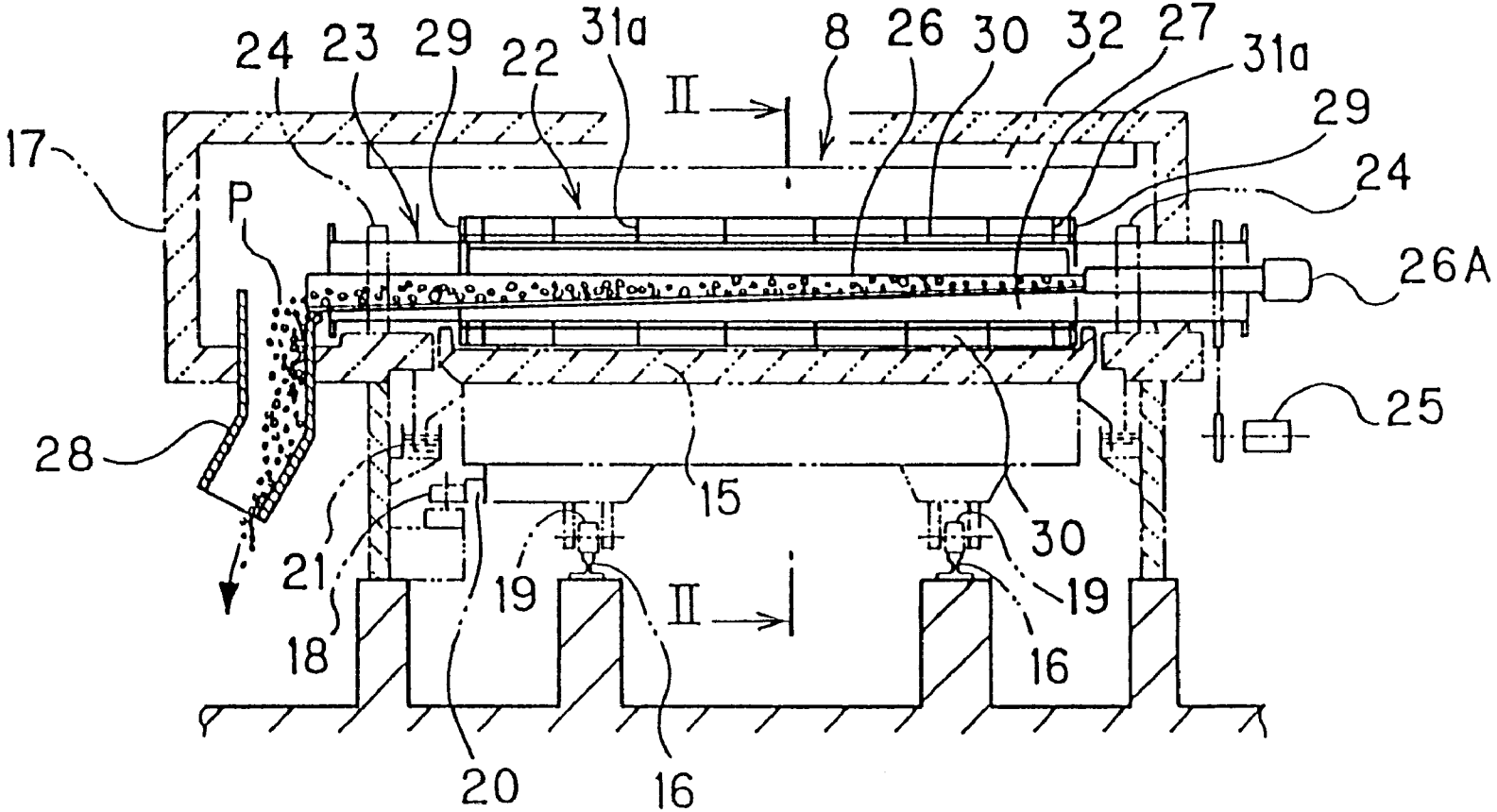
FIG. 1 is a vertical sectional view of a reduced iron discharger in a rotary hearth reducing furnace according to a first embodiment of the present invention.
Figure 2:
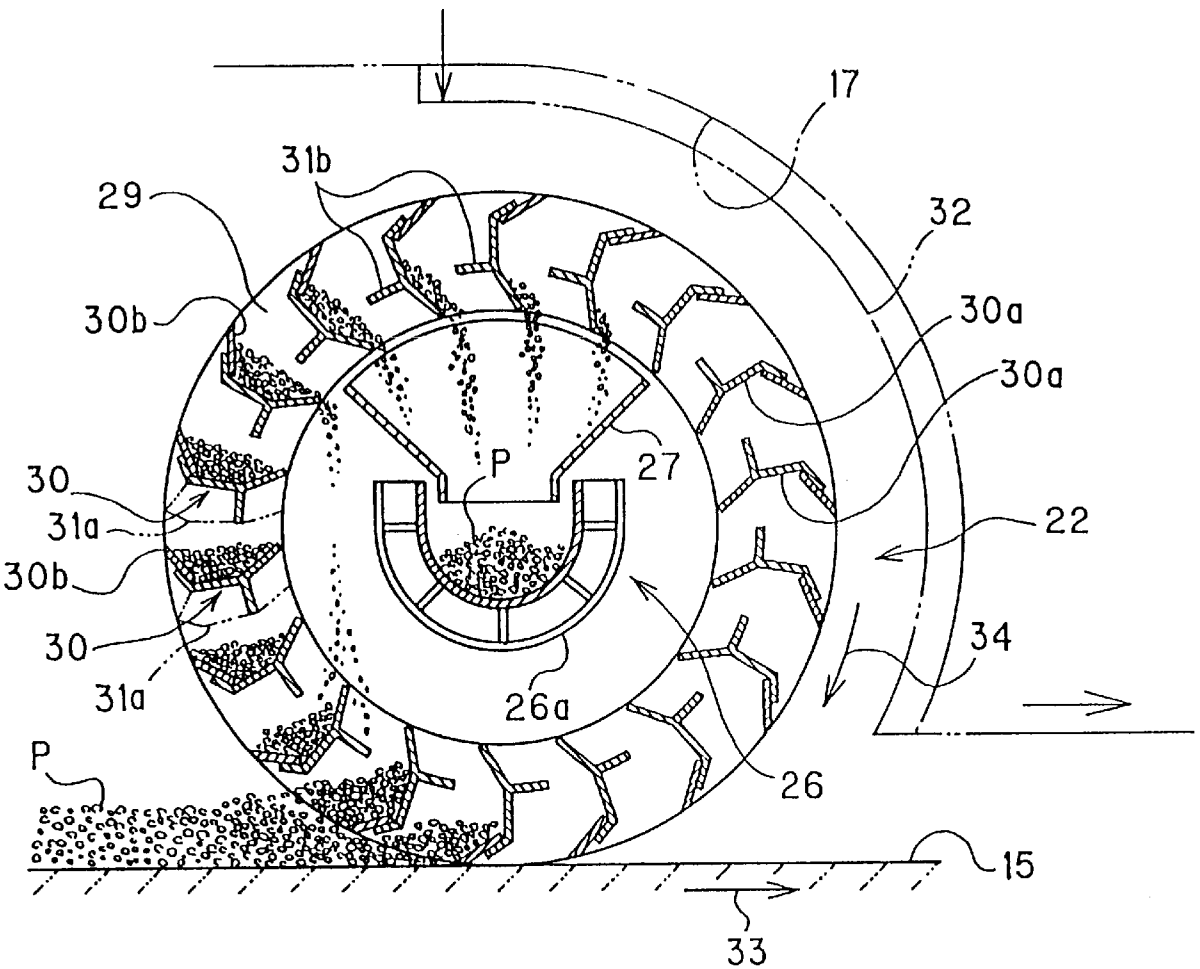
FIG. 2 is an enlarged sectional view taken along line II—II of FIG. 1.
Figure 7:
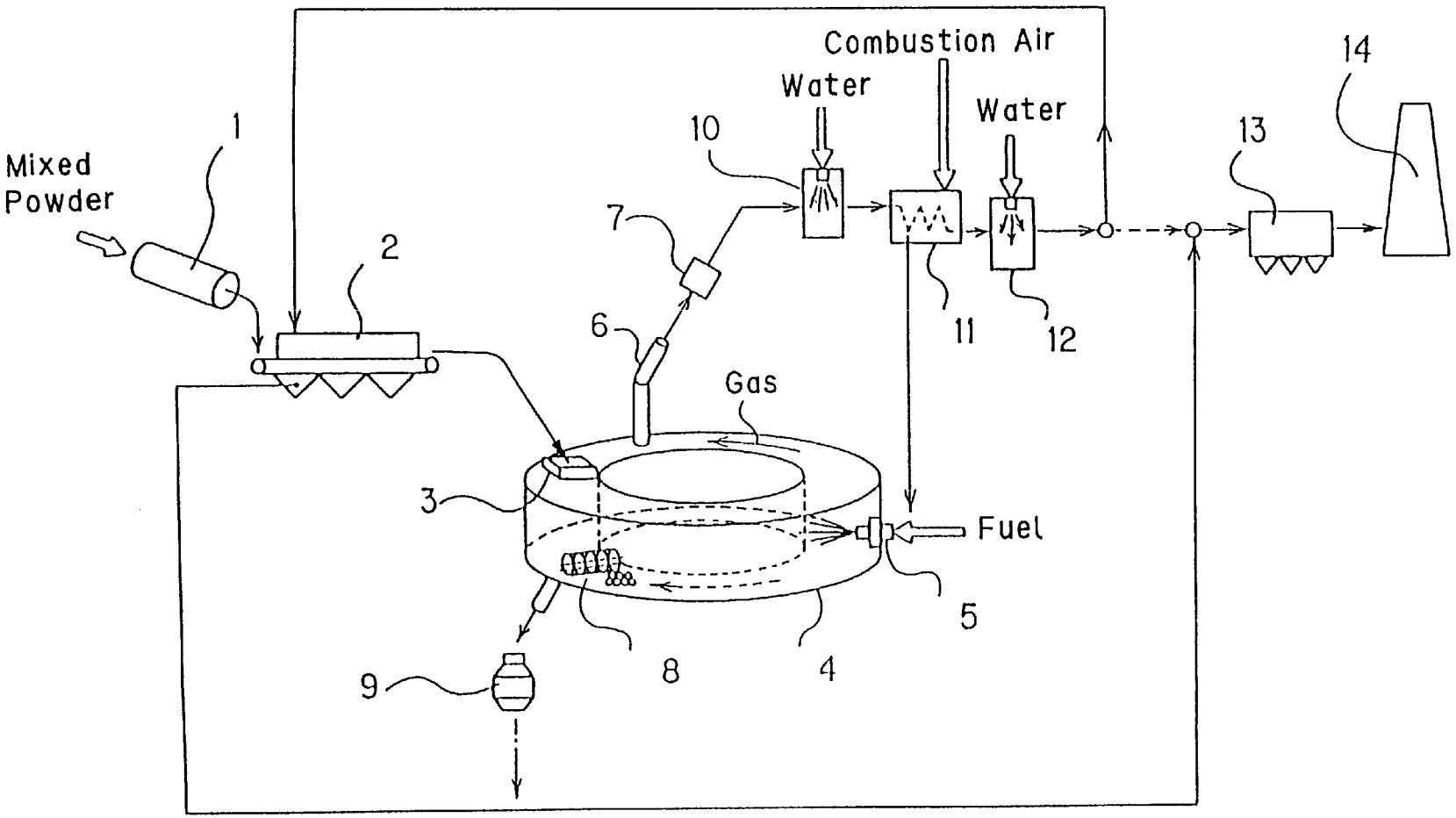
FIG. 7 is a schematic constitution drawing of an apparatus for producing reduced iron, which is equipped with a rotary hearth reducing furnace.
Figure 8:
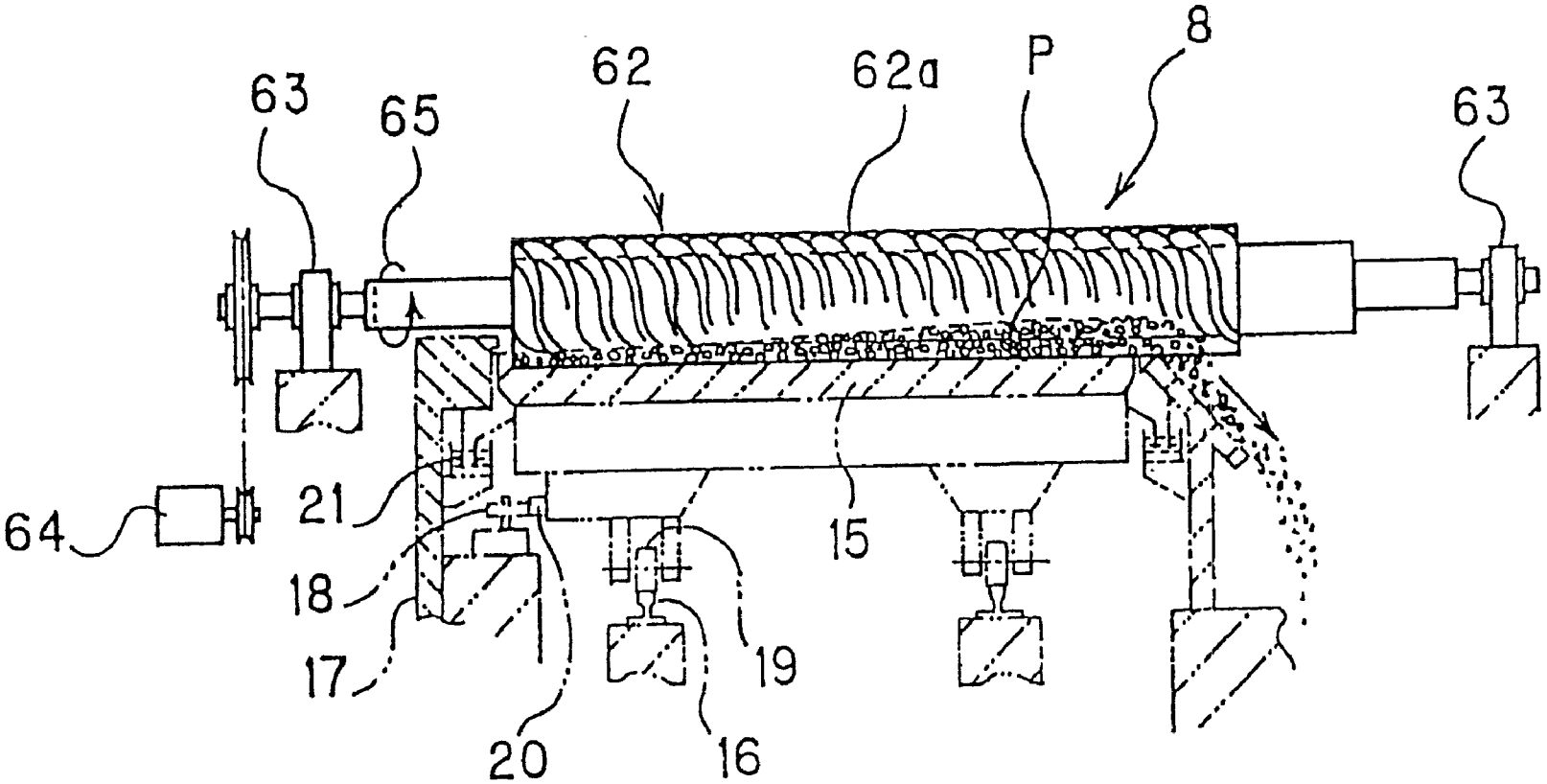
Fig.8 Prior Art
FIG. 8 is a vertical sectional view of a conventional screw discharger.

FIG. 1 is a vertical sectional view of a reduced iron discharger in a rotary hearth reducing furnace according to a first embodiment of the present invention. FIG. 2 is an enlarged sectional view taken along line II—II of FIG. 1. The structure other than the reduced iron discharger is the same as in the rotary hearth reducing furnace of FIG. 8. Thus, the same members and sites as in FIG. 8 are assigned the same reference numerals, and their detailed descriptions are omitted. An apparatus for producing reduced iron, equipped with the above rotary hearth reducing furnace, is the same as in FIG. 7, and duplicate explanations are omitted herein with reference to FIG. 7.

The present embodiment provides an apparatus for scooping up reduced iron on a rotary hearth from a front side with the use of an impeller long enough to cover the entire width of the rotary hearth, dropping the reduced iron onto a vibrating conveyor mounted in the impeller, and discharging it to the outside of the reducing furnace.

As shown in FIG. 1, an impeller discharger is used as a pellet discharger 8. The right side of the drawing is a central side of a reducing furnace 4 (see FIG. 7), while the left side of the drawing is an outer peripheral side of the reducing furnace 4. The pellet discharger 8 consists mainly of a hollow rotary tube 23 equipped with an impeller 22, bearings 24 for supporting portions near both ends of the rotary tube 23 on a furnace wall 17, a drive motor 25 for rotating the rotary tube 23, a heat resistant vibrating conveyor (transport device) 26 passing through a hollow portion of the rotary tube 23 so as to be inclined from an inside position of the impeller 22 to the outside of the furnace, and a relay hopper 27 fixedly disposed alone in a longitudinal direction between an upper side of the vibrating conveyor 26 and an inner side of the impeller 22. In the drawing, the numeral 28 denotes an outlet for withdrawal of reduced iron, the outlet being supported by the furnace wall 17, etc. and provided at a position at which one end of the vibrating conveyor 26 protrudes to the outside of the furnace. The numeral 26A denotes shaker means for the vibrating conveyor 26.

As shown in FIG. 2 as well, the impeller 22 is constituted by disposing many scooping members (blades) 30 of a curved cross-section between a pair of flanges 29 arranged on the rotary tube 23 at the same positions as the width of a rotary hearth 15. The scooping members are each welded at both ends to the flanges 29 and provided at equal intervals in a circumferential direction and parallel to an axial direction. Each of the scooping members 30 is composed of a body member 30*a* and a front end member 30*b*. The members 30*a* and 30*b* are bolted together, and the front end member 30*b*, which bites into the reduced iron P and easily wears, is replaceable. The body member 30*a* is reinforced with ribs 31*a*, 31*b*, as desired. The vibrating conveyor 26 is in a grooved form having an upwardly curved smooth surface, has an outer reinforcing member 26*a* supported outside the rotary tube 23 so as to be able to vibrate, has shaker means 26A for generating vibrations in either a longitudinal direction or a vertical direction, and delivers reduced iron P to the outside of the furnace along the direction of inclination of the conveyor. The relay hopper 27 has a structure of a fan-shaped cross-section, and has opposite end portions in a longitudinal direction supported fixedly outside the rotary tube 23.

The impeller 22, vibrating conveyor 26, relay hopper 27, and scooping member 30 may have shapes other than those mentioned above. Furthermore, a radiant cooling plate 32 may be provided along the furnace wall 17 so that each of the scooping members 30 after discharging (dropping) reduced iron P is cooled above the rotary hearth 15.

Figure 9:
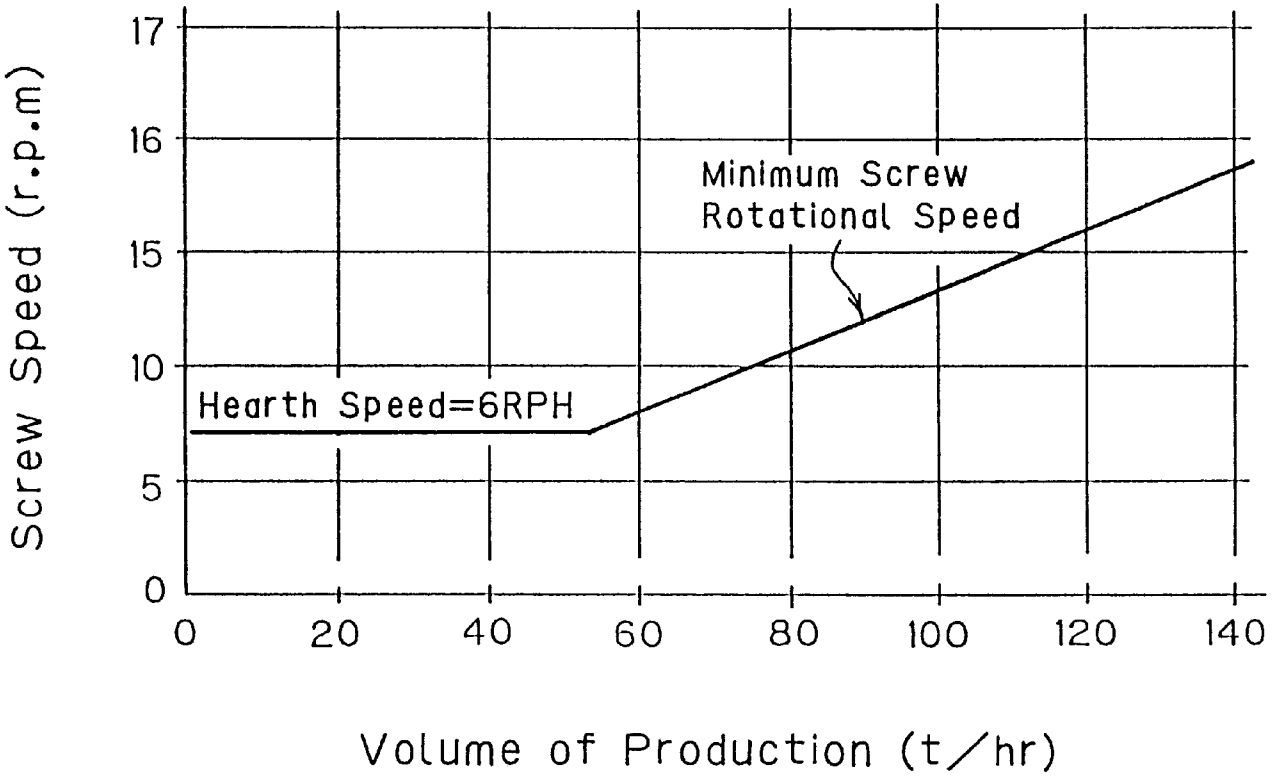
FIG. 9 is a graph showing the relationship among the necessary rotational speed of a discharge screw, the rotational speed of a rotary hearth, and the volume of production.

Because of the foregoing features, when reduced pellets with a certain thickness, i.e., reduced iron P, borne on the rotary hearth 15 moves in the direction of an arrow 33 at a rotational speed complying with a production plan, the rotary tube 23 equipped with the impeller 22 is driven in the direction of an arrow 34 (rotated about an axis extending across the rotary hearth 15), for example, at a rotational speed corresponding to the volume of production as shown in FIG. 9. The reduced iron P moving upon rotation of the rotary tube 23 having the impeller 22 is sequentially scooped up and raised by the many scooping members 30 of the impeller 22 rotating uniformly over the entire width of the rotary hearth 15. When the inside of the scooping members 30 inclines downwardly at a rotating ascending position, the reduced ion P in the scooping members 30 falls into the relay hopper 27, and rides on the vibrating conveyor 26 with a uniform weight distribution. In accordance with the vibration of the vibrating conveyor 26, the reduced iron P is discharged to the outside of the furnace along the inclination of the vibrating conveyor 26. At this time, the reduced iron P is sent from the site on the rotary hearth 15 to the site on the vibrating conveyor 26 parallel to the moving direction of the rotary hearth 15 over the entire width of the rotary hearth 15. On the other hand, the reduced iron P on the vibrating conveyor 26 is discharged to the outside of the furnace through the outlet 28 after being spread in a uniformly distributed state throughout the width of the hearth by the vibration of the vibrating conveyor 26. Thus, pellets of the reduced iron do not undergo pressure, impact, or excessive friction from each other during the lateral discharge of the reduced iron from the reducing furnace 4. Thus, powdering of the reduced iron P is markedly diminished, and a decrease in the yield is dissolved.

Moreover, the scooping members 30 of the impeller 22 scoop up the reduced iron P on the rotary hearth 15 to a uniform depth in the entire region in the longitudinal direction, and rotationally raise the reduced iron P with a uniform load distribution. Thus, the structural surplus size becomes unnecessary to avoid waste. Besides, the use of a heat resistant steel can be restricted to the impeller 22, and when the front end portion of the scooping member 30 wears, only the front end member 30*b* can be easily replaced.

[Second Embodiment]

Figure 3:
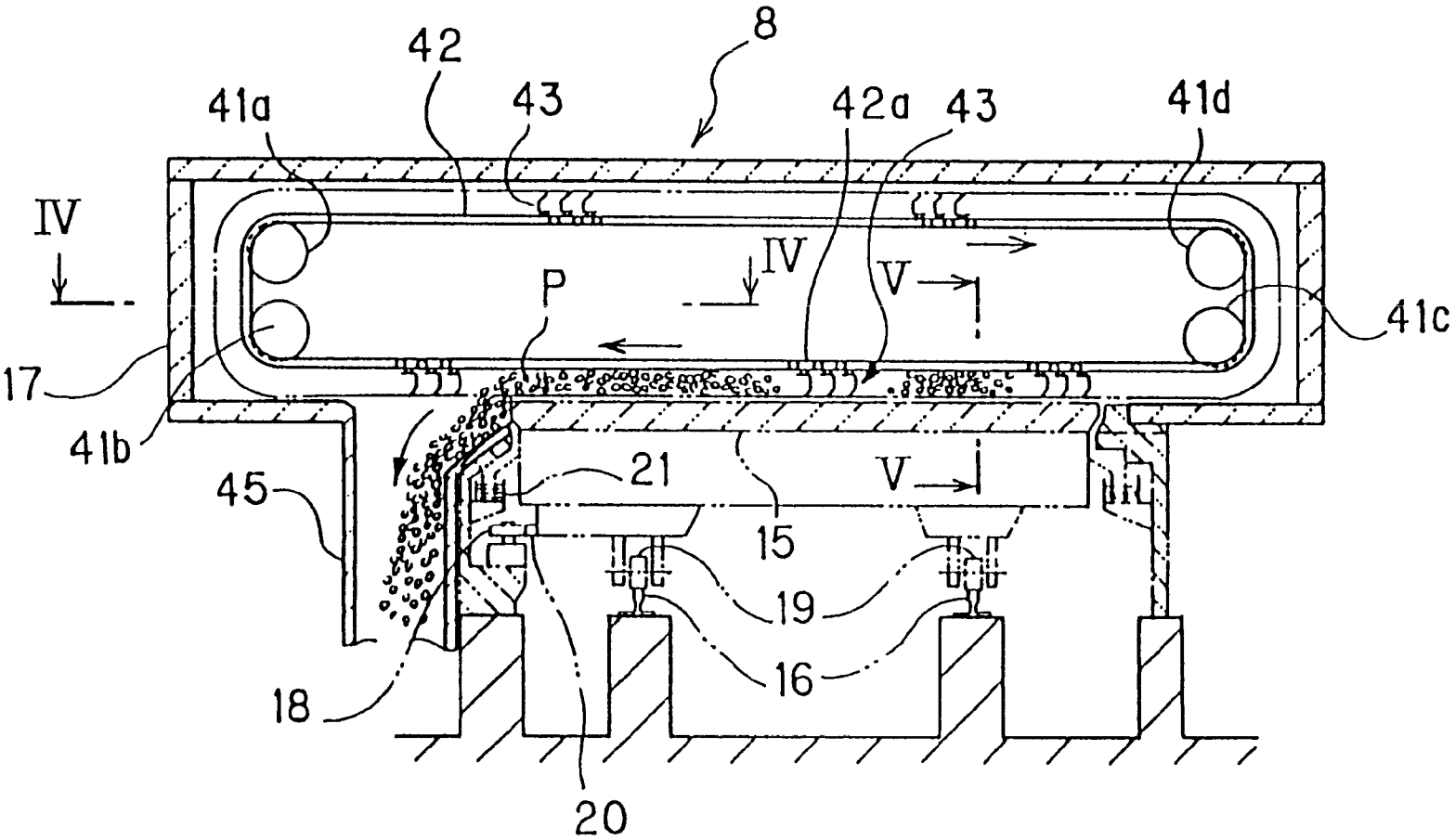
FIG. 3 is a vertical sectional view of a reduced iron discharger in a rotary hearth reducing furnace according to a second embodiment of the present invention.
Figure 4:
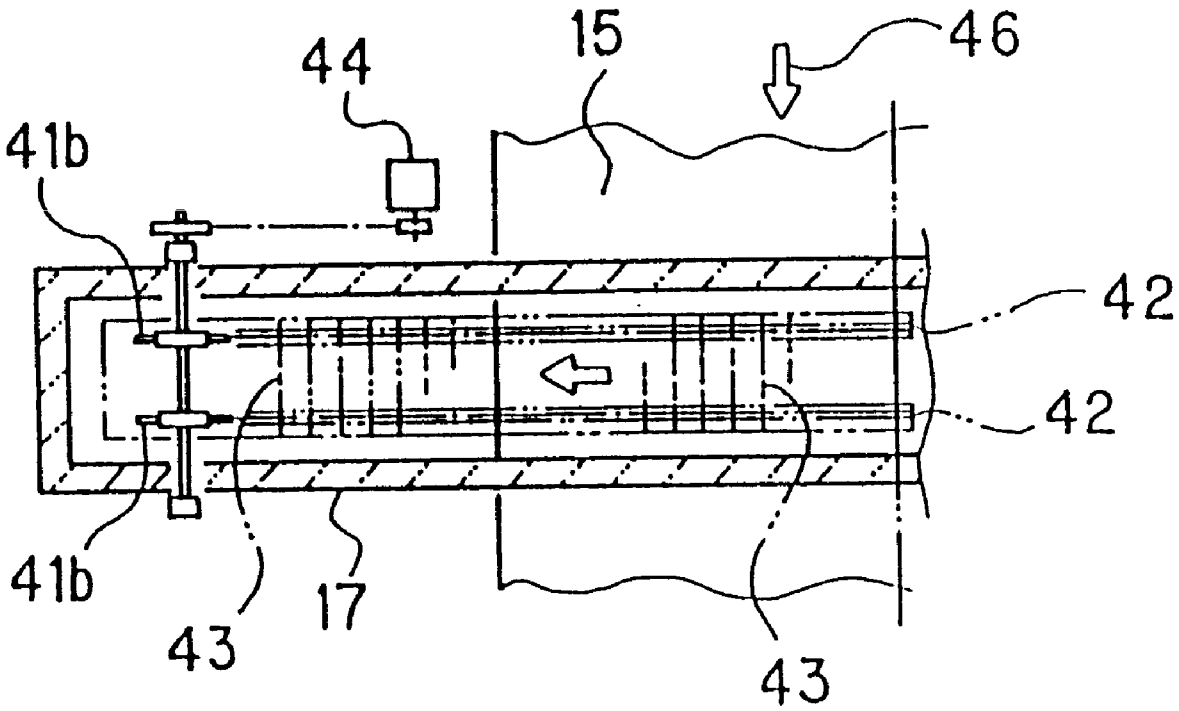
FIG. 4 is a view taken along line IV—IV of FIG. 3.
Figure 5:
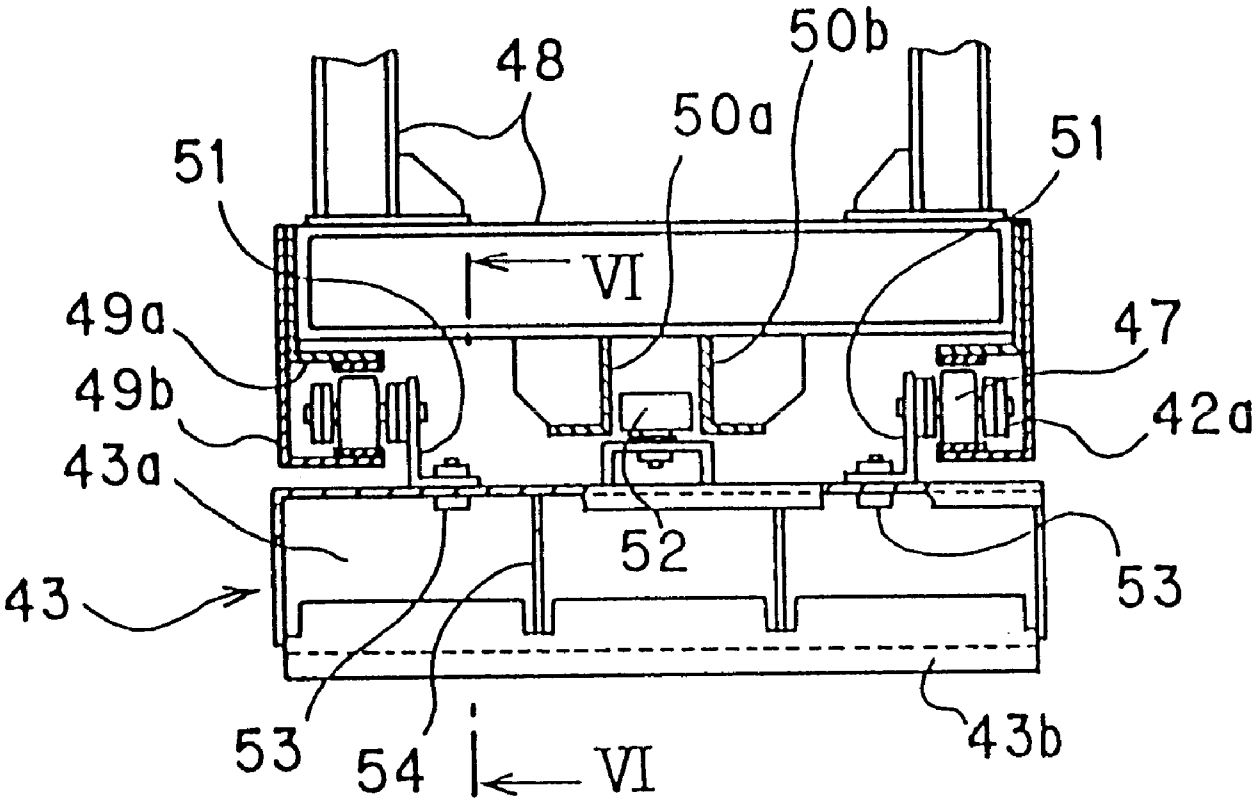
FIG. 5 is an enlarged view taken along line V—V of FIG. 3.
Figure 6:
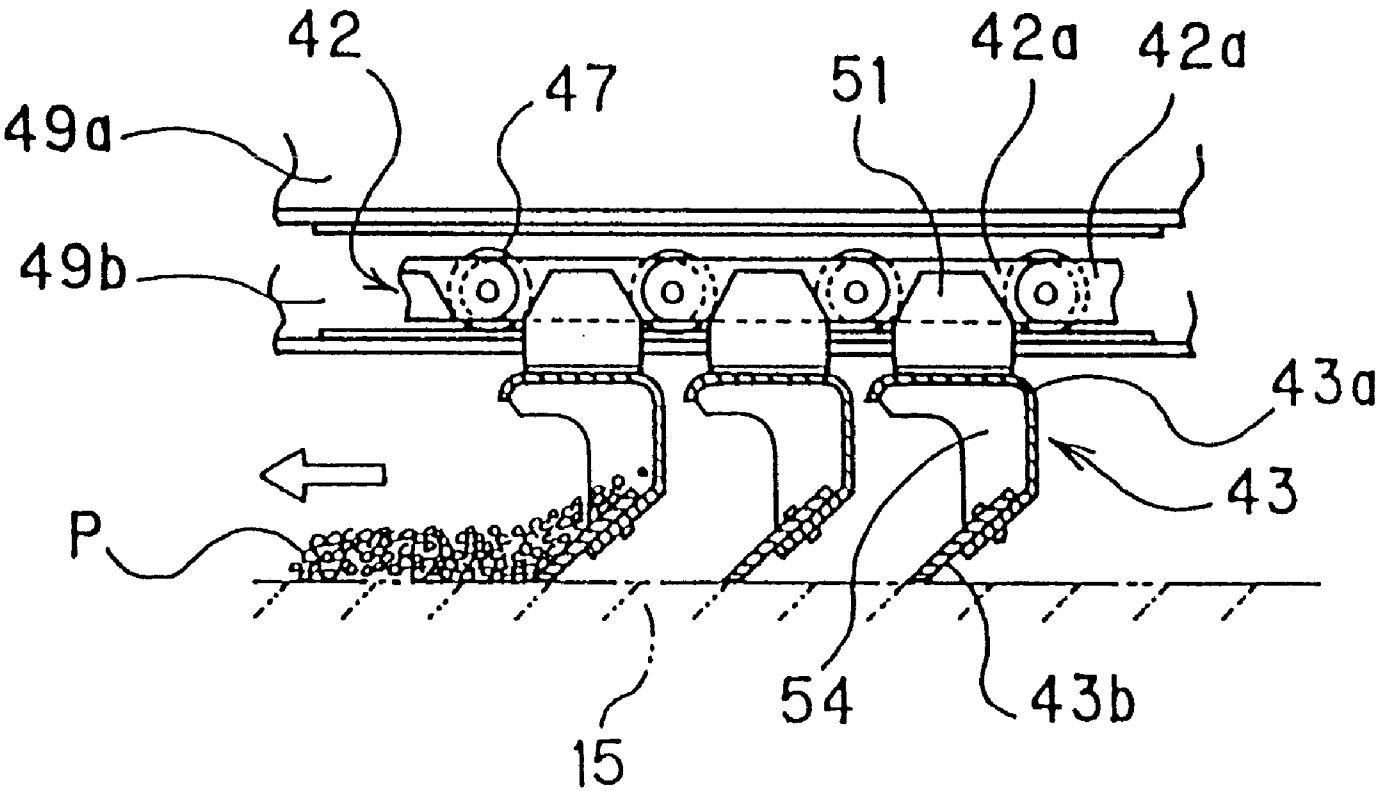
FIG. 6 is a view taken along line VI—VI of FIG. 5.

FIG. 3 is a vertical sectional view of a reduced iron discharger in a rotary hearth reducing furnace according to a second embodiment of the present invention. FIG. 4 is a view taken along line IV—IV of FIG. 3. FIG. 5 is an enlarged view taken along line V—V of FIG. 3. FIG. 6 is a view taken along line VI—VI of FIG. 5. The structure other than the reduced iron discharger is the same as in the rotary hearth reducing furnace of FIG. 8. Thus, the same members and sites as in FIG. 8 are assigned the same reference numerals, and their detailed descriptions are omitted. An apparatus for producing reduced iron, equipped with the above rotary hearth reducing furnace, is the same as in FIG. 7, and duplicate explanations are omitted herein with reference to FIG. 7.

The present embodiment provides an apparatus for raking out reduced iron on a rotary hearth to the outside of the furnace by raking-out devices which circulate above a rotary hearth in a width direction (traversing direction) by a chain link mechanism.

As shown in FIGS. 3 and 4, a raking-out discharger, such as a reclaimer, is used as a pellet discharger 8. The right side of the drawing is a central side of a reducing furnace 4 (see FIG. 7), while the left side of the drawing is an outer peripheral side of the reducing furnace 4. The pellet discharger 8 consists mainly of two parallel link chains 42 endlessly passed over two pairs (upper and lower pairs) of sprocket wheels 41*a*, 41*b*, 41*c*, 41*d* having shafts rotatably supported by furnace wall 17 above both sides of a rotary hearth 15, raking-out members (blades) of a ワ-shaped cross-section integrally supported by respective links 42*a* (see FIG. 6) of the link chains in one direction. In FIG. 3, the reference numeral 45 denotes an outlet for reduced iron P formed in the furnace wall 17 on the outer peripheral side of the rotary hearth 15. In FIG. 4, the reference numeral 46 denotes an arrow showing the direction of rotation of the rotary hearth 15. The link chains 42 are installed in a width direction of the rotary hearth 15, and the raking-out members 43 are supported by the two link chains 42 so as to be arranged parallel to the direction of rotation (see the arrow 46) of the rotary hearth 15.

In FIGS. 5 and 6, the reference numeral 47 denotes a guide roller supported on each of the connecting shafts of the links 42*a* of the two endless link chains 42. The reference numeral 48 denotes an apparatus mounting frame supported on the furnace wall 17. The reference numerals 49*a* and 49*b* denote, respectively, a height position holding upper surface guide rail and a height position holding lower surface guide rail supported on both sides of the frame 48 and arranged in contact with upper and lower surfaces of the guide roller 47 of each of the link chains 42. The reference numerals 50*a* and 50*b* denote raking-out direction position holding side surface guide rails supported by a lower surface of the frame 48 so as to have vertical surfaces opposed to each other, with a middle line between the two link chains 42 being interposed between the vertical surfaces. The reference numeral 51 denotes a raking-out member connecting an L-member integrally bonded to an inner side surface of each of the links 42*a*.

The raking-out member 43 is composed of a body member 43*a* of a ワ-shaped cross-section of a required length provided with a reinforcing rib 54, and a front end member 43*b* detachably bolted to the body member 43*a*. A horizontal roller 52 is provided at the center of an upper surface of the body member 43*a* so as to be loosely fitted between the side surface guide rails 50*a* and 50*b* on the lower surface of the frame 48. A symmetric portion of the upper surface of the body member 43*a* is coupled to the L-members 51 on the symmetric links 42*a* of the two link chains 42 by bolts and nuts 53. In this state, the two endless link chains 42 are kept at a constant height while being guided by the upper surface and lower surface guide rails 49*a* and 49*b* of FIG. 5 about the four sprocket wheels 41*a* to 41*d* provided in either side in FIG. 3. Also, the two endless link chains 42 can circulate while maintaining a predetermined raking-out position, because they are guided by the side surface guide rails 50*a*, 50*b* and horizontal roller 52 of FIG. 5.

Because of the foregoing features, the reduced pellets with a certain thickness, i.e., reduced iron P, borne on the rotary hearth 15 is traversed while being stored in the spaces between the many raking-out members 43 circulated at a set speed, and discharged to the outside of the furnace through the outlet 45. A traversing force imposed by the raking-out member 43 on the reduced iron P to be raked out acts on a limited portion of reduced iron held in each spacing between the adjacent raking-out members 43. Thus, the pressure exerted on the grains of reduced iron is averaged in the entire region in the width direction of the rotary hearth 15. Consequently, powdering of reduced ion P by friction among the grains of the reduced iron is markedly diminished compared with the conventional screw discharger.

In the apparatus of the foregoing constitution, the length of the raking-out member 43 (the width of the blade) may be set to agree with an operation for high volume production by the reducing furnace 4 (maximum speed of the rotary hearth 15). By so doing, the amount of reduced iron escaping the raking-out discharger can be decreased without the need to increase the circulating speed of the raking-out discharger in response to an increase in the volume of production in an operation for production of up to a high volume. In an operation falling short of the operation for high volume production, a surplus in the length of the raking-out member 43 occurs. However, a loss due to the surplus in the structure is minimal, because the volume of production by such operation is low. To increase the volume of production over the set value, operation may be performed, with the circulating speed of the raking-out discharger being increased. In this case, excessive raking-out pressure is not imposed, and powdering during discharge of reduced iron can be minimized.

Besides, the present embodiment produces the advantage that on-line maintenance of the raking-out members 43 can be performed on the upper turnover side of the link chains 42. In addition, only the easy to-wear front end member 43*a* of the raking-out member 43 can be replaced easily.

The present invention being thus described, it will be obvious that the same is not limited to the foregoing embodiments, but may be varied in many ways. For example, the embodiments have been illustrated, with the agglomerates of the materials for reduction being restricted to pellets. However, the invention can be applied similarly to briquettes as the agglomerates.

What is claimed is:

1. A reduced iron discharger in a rotary hearth reducing furnace for producing reduced iron by reducing agglomerates in a high temperature atmosphere, the agglomerates being pelletized from a powdery mixture of an iron oxide powder and a reducing agent and supplied onto a rotary hearth, wherein the discharger comprises a plurality of rotary blades aligned generally across the direction of travel of the rotary hearth capable of scooping the reduced iron pellets from the rotary hearth and then discharging the reduced iron from the rotary hearth, each of the blades comprising a body member and a front end member detachably provided on the body member.

2. The reduced iron discharger in a rotary hearth reducing furnace as claimed in claim 1, wherein the body member is reinforced with a rib.

3. A reduced iron discharger in a rotary hearth reducing furnace for producing reduced iron by reducing agglomerates in a high temperature atmosphere, the agglomerates being pelletized from a powdery mixture of an iron oxide powder and a reducing agent and supplied onto a rotary hearth, wherein the discharger comprises a plurality of rotary blades aligned generally across the direction of travel of the rotary hearth capable of scooping the reduced iron pellets from the rotary hearth and then discharging the reduced iron from the rotary hearth, wherein the blades are composed of an impeller which rotates about an axis extending across the rotary hearth and scoops up the reduced iron, and a transport device for accepting the reduced iron falling at a rotating ascending position of the impeller, and discharging the reduced iron to an outside of the furnace is mounted in the impeller.

4. The reduced iron discharger in a rotary hearth reducing furnace as claimed in claim 3, wherein the transport device is a vibrating conveyor disposed obliquely across the rotary hearth.

5. A reduced iron discharger in a rotary hearth reducing furnace for producing reduced iron by reducing agglomerates in a high temperature atmosphere, the agglomerates being pelletized from a powdery mixture of an iron oxide powder and a reducing agent and supplied onto a rotary hearth, wherein the discharger comprises a plurality of rotary blades aligned generally across the direction of travel of the rotary hearth capable of scooping the reduced iron pellets from the rotary hearth and then discharging the reduced iron from the rotary hearth, wherein cooling means is provided for cooling the blades, which have discharged the reduced iron, above the hearth.

* * * * *